United States Patent [19]

Suntola et al.

[11] 4,396,864

[45] Aug. 2, 1983

[54] ELECTROLUMINESCENT DISPLAY COMPONENT

[75] Inventors: Tuomo S. Suntola; Jorma O. Antson, both of Espoo; Ralf Graeffe, Porvoo; Sven G. Lindfors, Espoo; Arto J. Pakkala, Evitskog, all of Finland

[73] Assignee: Oy Lohja AB, Virkkala, Finland

[21] Appl. No.: 251,088

[22] Filed: Apr. 6, 1981

[30] Foreign Application Priority Data

Apr. 24, 1980 [FI] Finland ..... 801319

[51] Int. Cl.[3] ..... H01J 1/62; H01J 63/04

[52] U.S. Cl. ..... 313/506; 313/112

[58] Field of Search ..... 313/506, 505, 463, 494, 313/509, 112; 427/66, 68; 204/192 P

[56] References Cited

U.S. PATENT DOCUMENTS 3,242,260 3/1966 Cooper et al. ..... 313/473 X 3,531,585 9/1970 Strain ..... 313/506 X

FOREIGN PATENT DOCUMENTS 937711 9/1963 United Kingdom ..... 313/506

OTHER PUBLICATIONS

Fischer, "Flat TV Panels with Polycrystalline Layers", pp. 4–15 of Microelectronics, vol. 7, No. 4; Mackintosh Publications Ltd. Luton.

*Primary Examiner*—Alfred E. Smith

*Assistant Examiner*—K. Wieder

*Attorney, Agent, or Firm*—Fitzpatrick, Cella, Harper & Scinto

[57] ABSTRACT

Disclosed herein is an electroluminescence display component comprising, in sandwich arrangement, a transparent substrate made of, e.g., glass and two thin film structures, each comprising two electrode layers and a luminescence layer disposed between said electrode layers. A light filter layer is disposed between the different thin film structures for realizing a double color display. The light filter layer can be an integral layer made of homogeneous material or a sandwich structure comprising, e.g., two epoxy layers functioning as adhesive layers and a colored tape or similar element disposed between said epoxy layers.

7 Claims, 2 Drawing Figures

ELECTROLUMINESCENT DISPLAY COMPONENT

This invention relates to an electroluminescence display component comprising:

at least one transparent substrate made of, e.g., glass, at least two thin film structures (A, B), each comprising two electrode layers and a luminescence layer disposed between said electrode layers.

The prior art double colour, or triple colour, electroluminescence display components have a mosaic structure. In these components the display surface consists of overlapping element groups having different colours. The emission spectrum of the element groups can be different, or filters having different colours can be positioned in front of the different element groups if the emission spectrum is wide enough. Such a solution is presented, e.g., in the article: A. G. Fisher: Flat TV panels with polycrystalline layers, MICROELECTRONICS, Vol. 7, No. 4, 1976 Machintosh Publications Ltd., Luton.

As regards the general structure and manufacture of electroluminescence films, reference is made to, e.g., the U.K. patent publication Nos. 1,300,548 and 1,481,047, and the U.S. patent publication No. 3,889,151.

The mosaic nature of the structure is likely to cause production technical problems particularly in display components having a high resolution. On the other hand, even the simplest large figures (patterns) will have to be realized as a point mosaic by means of colour point overlapping in order to obtain an information display having different colours in one and the same surface area.

The object of this invention is to eliminate the drawbacks of the above prior art structures and to create a double colour, or multicolour, electroluminescence display component.

The invention is, on one hand, based on the idea that an electroleuminescence display structure (thin film) grown onto a glass substrate is transparent within the range of the spectrum of visible light and, on the other hand, that a luminescent material (e.g., ZnS:Mn) having a sufficient emission spectrum is used whereby the different colours can be realized by means of filtration.

In more accurate terms, the display component according to the invention is characterized by at least one light filter layer disposed between the different thin film structures for realizing a double colour, or multicolour, display.

By assembling the display component, e.g., out of two transparent thin film electroluminescence structures between which a coloured light filter is positioned, a double colour electroluminescence display component according to the invention can be realized. Depending on whether, at the considered surface portion, the voltage has been directed by means of transparent electrodes to a display element positioned in front of or behind the filter in relation to a viewer, either a colour (e.g., orange yellow) corresponding to the whole emission spectrum or the filter colour (e.g., red) while be observed.

By means of the invention considerable advantages are achieved. As the different colours of the display component are arranged as layers placed one on top of the other, even large display elements can be manufactured. The whole display area can be utilized as is the case in a monocolour display. In the different layers the electrode wirings can be made independently and they can always make use of the whole display area.

The invention will be examined in the following, reference being made to the embodiments according to the enclosed drawing.

The double colour electroluminescent display component consists of two separate thin film structures A and B on a glass substrate 1. They have been connected to face each other in such a way that a colour filter layer or a coloured light filter layer 5 is positioned between them. This layer can be manufactured, e.g., out of some transparent coloured ink or some optically transparent coloured epoxy known per se. One suitable raw material for optically transparent epoxy layers is commercially available as a curable paste from the Epoxy Technology Inc., Billerica, Ma 01821, U.S.A., under the type denomination EPO-TEK 301-2.

Figure 1:
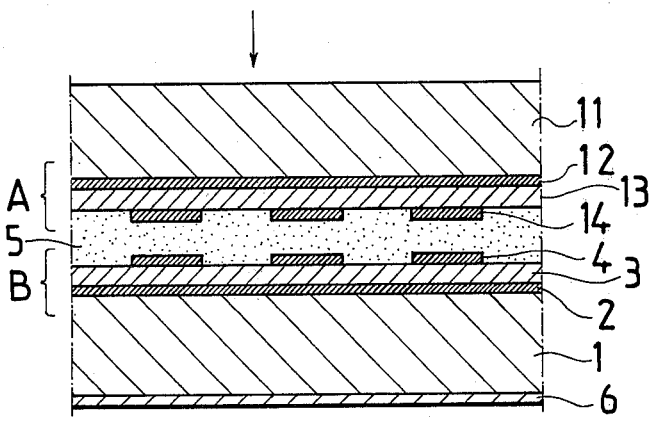
FIG. 1 is a sectional and partially diagrammatic view of one embodiment according to the invention.

In the structure according to FIG. 1 the transparent substrates 1 and 11 can be made of, e.g., glass. A transparent electrode layer 2, 12, having a desired configuration has been disposed on each of the substrates 1 and 11. An electroluminescence layer 3, 13, known per se has been disposed on each of the transparent electrode layers 2 and 12. Another electrode layer 4, 14 having a configuration of its own has been disposed on each of said luminescence layers 3 and 13. The luminescence layers 3, 13 are sandwich structures comprising a light emitting layer 3, 13 known per se, usually a ZnS:Mn layer, and current limiting auxiliary layers (not shown) which are typically made of some metal oxide. A coloured layer 5 is positioned between the thin film structures A and B. If, for instance, the structure is viewed from above (FIG. 1), the back of the lower glass 1 can be blackened by means of a separate black colour film 6 known per se in order to improve the contrast. The black layer 6 can, e.g., be made of any paint sprayed on the glass substrate 6.

Hence, it is necessary that both electrode layers 2, 12 and 4, 14 as well as the luminescence layer 3, 13 in each thin film structure A and B are transparent. The electrode layers 2, 12 and 4, 14 can be, e.g., sputtered ITO (Indium-Tin-Oxide) films. The luminescence layers 3, 13 emit light having a sufficiently wide spectrum.

If the light filter layer 5 is, e.g., red, the configuration defined by the electrodes 4 of the lower thin film structure B will look red. On the other hand, the configuration defined by the electrodes 14 of the upper thin film structure A will look orange yellow.

The light filter layer 5 can be manufactured integrally by means of a silk printing process known per se. Alternatively, it is possible to use a sandwich structure consisting of two optically transparent, colourless epoxy layers between which a coloured tape known per se or similar has been inserted. The epoxy layers function as adhesive layers connecting the different layers to each other. In addition, a separate coloured film known per se or similar can be used as a light filter layer.

Figure 2:
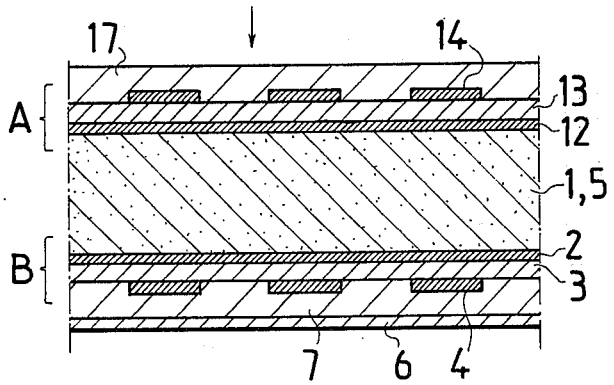
FIG. 2 is a sectional and partially diagrammatic view of a second embodiment according to the invention.

In the structure according to FIG. 2, the double colour electroluminescence display component has been realized in such a way that the coloured glass 1 functioning as substrate simultaneously functions as light filter, and the thin film structures A and B have been grown on opposite sides thereof. The reference numerals according to FIG. 2 correspond to those of FIG. 1 except that the reference numerals 7 and 17 denote optionally necessary transparent protection layers.

The transparent glass or plastic layer 1 can contain, e.g., some organic red pigment known per se. It is also possible to use, e.g., exposed red film.

Within the scope of the invention, structures differing from the above embodiments are conceivable. Hence, a multicolour display can be realized by increasing the number of thin film structures A, B and the light filter layers 5 disposed between said thin film layers. By using, e.g., three thin film tructures and, correspondingly, two light filter layers having different colours and being disposed between the thin film layers, a triple colour display can be realized.

What we claim is:

1. An electroluminescence display component comprising:

(a) at least one transparent substrate made of, e.g., glass;

(b) at least two thin film structures, each comprising two electrode layers and a luminescence layer disposed between said electrode layers; and (c) at least one light filter layer disposed between said two thin film structures for realizing at least a two-colour display.

2. A component as claimed in claim 1, wherein the light filter layer is an integral layer made of homogeneous material.

3. A component as claimed in claim 1, wherein the light filter layer is a sandwich structure comprising two epoxy layers functioning as adhesive layer and a coloured tape disposed between said epoxy layers.

4. A component as claimed in claim 1, wherein the light filter layer is made of a separate colour film.

5. A component as claimed in claim 1, wherein the light filter layer is a transparent, coloured substrate disposed between the thin film structures.

6. A component as claimed in claim 5, wherein the substrate is a glass layer blended with some organic pigment.

7. A component as claimed in claim 1, comprising two light filter layers having different colours and being disposed between alternate ones of three of said thin film structures for realizing a triple colour display.

* * * * *